US007141928B2

(12) United States Patent
Kim et al.

(10) Patent No.: US 7,141,928 B2
(45) Date of Patent: Nov. 28, 2006

(54) FLAT LAMP AND METHOD OF DRIVING THE SAME

(75) Inventors: Gi-young Kim, Chungcheongbuk-do (KR); Hyoung-bin Park, Kyungki-do (KR); Seung-hyun Son, Kyungki-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 47 days.

(21) Appl. No.: 10/731,027

(22) Filed: Dec. 10, 2003

(65) Prior Publication Data

US 2004/0119420 A1 Jun. 24, 2004

(30) Foreign Application Priority Data

Dec. 10, 2002 (KR) ..... 10-2002-0078170

(51) Int. Cl.
*H01J 17/00* (2006.01)

(52) U.S. Cl. ..... 313/581; 313/585; 313/586

(58) Field of Classification Search ..... 313/585, 313/586, 587, 582, 581; 315/169.3
See application file for complete search history.

(56) References Cited

U.S. PATENT DOCUMENTS 6,603,265 B1 * 8/2003 Ahn et al. ..... 313/586
6,747,407 B1 * 6/2004 Saito et al. ..... 313/581
6,798,144 B1 * 9/2004 Mori et al. ..... 315/169.1

FOREIGN PATENT DOCUMENTS

KR 1998-072077 10/1998
KR 2002-0071641 9/2002

OTHER PUBLICATIONS

Korean Patent Office Action and English Translation, Feb. 19, 2005.

* cited by examiner

*Primary Examiner*—Tuyet Thi Vo
(74) *Attorney, Agent, or Firm*—Buchanan Ingesoll & Rooney PC

(57) ABSTRACT

A flat lamp and a method of driving the same are provided. The flat lamp includes a front panel and a rear panel, which are spaced a predetermined distance apart from each other and hermetically sealed, and a spacer, which is provided between the front panel and the rear panel to maintain the front and rear panels separated by the predetermined distance and secure a discharge space. A predetermined discharge gas exists in the discharge space, and a fluorescent layer is formed on an inner surface of at least one of the front and rear panels. In the flat lamp, a plurality of electrode groups, each of which includes at least three electrodes, are provided in the rear panel.

18 Claims, 12 Drawing Sheets

FLAT LAMP AND METHOD OF DRIVING THE SAME

CROSS-REFERENCE TO RELATED APPLICATIONS

This application claims the priority of Korean Patent Application No. 2002-78170, filed on Dec. 10, 2002, in the Korean Intellectual Property Office, the disclosure of which is incorporated herein by reference.

BACKGROUND OF THE INVENTION

1. Field of the Invention

The present invention relates to a flat lamp and a method of driving the same, and more particularly, to a flat lamp used in a light source unit for a flat display, for example, a back light unit for a liquid crystal display (LCD), and a method of driving the same.

2. Description of the Related Art

An LCD is a representative light receiving flat display, and a plasma display panel (PDP) is a representative self-luminescent flat display. A PDP has advantages such possibility of being used in a large screen and a memorization characteristic, but it is difficult to be manufactured in a small size. Accordingly, a PDP is usually used for a large-screen TV. An LCD is equal to or better than a PDP in performance. Accordingly, an LCD is used for most small or middle-sized displays.

An LCD includes a back light unit (BLU) as a light source unit for uniformly illuminating light on the entire surface of a liquid crystal panel. The BLU includes a light source, and the structure of the BLU changes depending on the type of the light source.

Cold cathode fluorescent lamps are widely used as the light sources in BLUs. However, the use of cold cathode fluorescent lamps has gradually decreased due to unsatisfactory luminance, uniformity, and environmental affinity. Surface discharging type or facing surfaces discharging type flat lamps have been developed as light sources replacing cold cathode fluorescent lamps and have already been used in some flat display products.

In flat lamps, other discharging gas than mercury, for example, xenon (Xe), is used. Accordingly, flat lamps are better than cold cathode fluorescent lamps in terms of environmental affinity. In addition, a flat lamp is installed in the back of a flat display panel, e.g., a liquid crystal panel, in parallel with the liquid crystal panel. The size of the flat lamp is usually the same as the size of the liquid crystal panel. Accordingly, when a flat lamp is used as a light source of a flat display, light loss is reduced, and therefore, luminance increases. Moreover, since a flat lamp radiates light from the entire surface at a uniform intensity, light is radiated on the entire surface of a display panel, e.g., a liquid crystal panel, of a flat display, thereby increasing the uniformity of the flat display.

Various types of flat lamps have been developed. FIGS. 1 and 2 are cross-sections of examples of a conventional flat lamp.

Referring to FIG. 1, a conventional flat lamp includes a front panel 10, a rear panel 20, and spacers 22, provided in a discharge space 24 between the front panel 10 and the rear panel 20, for supporting the front panel 10 and the rear panel 20. The front panel 10 includes a first glass substrate 10*a* and a first fluorescent layer 10*b* formed on the back surface of the first glass substrate 10*a*. The rear panel 20 includes a second glass substrate 20*a*, a dielectric layer 20*b* and a second fluorescent layer 20*c* which are sequentially formed on the second glass substrate 20*a*, and a plurality of electrodes 20*d* and 20*e* which are arranged in a striped pattern between the second glass substrate 20*a* and the dielectric layer 20*b*. An electrode 20*d* and an electrode 20*e* form an electrode pair, and a plurality of electrode pairs exist between the second glass substrate 20*a* and the dielectric layer 20*b*. The plurality of electrode pairs are separated from one another by a predetermined distance d1, which may be greater than a distance d2 between two electrodes in each electrode pair (d1>d2).

When a driving voltage higher than a discharge starting voltage is applied to the electrodes 20*d* and 20*e* of the rear panel 20, a discharge occurs between two electrodes in each electrode pair. Due to these discharges, high-temperature electrons are produced in the discharge space 24. The high-temperature electrons excite a neutral discharge gas, e.g., Xe gas, in the discharge space 24. When the excited discharge gas returns to a base state, ultraviolet rays are radiated from the excited discharge gas. The radiated ultraviolet rays excite a fluorescent material of the first and second fluorescent layers 10*b* and 20*c*. When the excited fluorescent material returns to the base state, visual light is radiated from the fluorescent material. As a result, visual light is radiated from the first and second fluorescent layers 10*b* and 20*c*, and then the radiated visual light is transmitted outside the flat lamp through the first glass substrate 10*a*.

Another conventional flat lamp having a different structure from the flat lamp shown in FIG. 1 will be described with reference to FIG. 2. In the flat lamp shown in FIG. 2, a plurality of igniters 30*a* are provided on the back surface of a front glass substrate 30. Each igniter 30*a* includes two wires, which protrude from the back surface of the front glass substrate 30 and are spaced a predetermined distance apart. The igniter 30*a* is used to trigger a discharge. A plurality of electrodes 40*a*, 40*b*, and 40*c* are repeatedly arranged on a rear glass substrate 40, facing the front glass substrate 30, at predetermined distances, which are greater than the distance between two wires in each igniter 30*a*, such that two auxiliary electrodes 40*b* and 40*c* are respectively arranged at opposite sides of a main electrode 40*a* in parallel. A plurality of tips P are alternately formed along each main electrode 40*a* at predetermined distances. The tips P face opposite directions.

When a discharge is triggered by the igniter 30*a*, plasma is formed between the front glass substrate 30 and the rear glass substrate 40, and therefore, charged particles are produced between the front glass substrate 30 and the rear glass substrate 40. The discharge triggered by the igniter 30*a* is sustained due to a surface discharge among the electrodes 40*a*, 40*b*, and 40*c*. Due to the charged particles, the surface discharge occurs at a low voltage. A surface discharge area among the electrodes 40*a*, 40*b*, and 40*c* includes a plurality of microscopic surface discharge areas.

More specifically, a single microscopic surface discharge area 40*e* is formed between one of the tips P formed along the main electrode 40*a* and the auxiliary electrode 40*b* or 40*c* facing the tip P. Accordingly, as many microscopic surface discharge areas 40*e* as the number of tips P formed along the main electrode 40*a* are formed among the main electrode 40*a* and the auxiliary electrodes 40*b* and 40*c*. A surface discharge area among the main electrode 40*a* and the auxiliary electrodes 40*b* and 40*c* is the sum of these microscopic surface discharge areas 40*e*.

Accordingly, when the conventional flat lamp shown in FIG. 2 is used, a discharge can be prevented from being concentrated on particular portions of adjacent electrodes, and a reliable discharge can be provided because a surface discharge area includes many microscopic discharge areas 40*e*.

However, each microscopic discharge area 40*e* becomes wider from a peak, i.e., a tip P, to an auxiliary electrode 40*b* or 40*c* facing the tip P, at an angle much smaller than 180°. Accordingly, an area, in which a microscopic discharge does not occur, may exist between tips P although it is very small. In addition, the distance between the main electrode 40*a* and the auxiliary electrodes 40*b* and 40*c* is wide. Accordingly, luminance and uniformity are unavoidably decreased.

In the meantime, when visual light is obtained using a gas discharge as in a flat lamp, a luminescence efficiency is calculated using the following formula:

$$\eta = \frac{\pi SB}{W} = \frac{\pi SB}{VI}.$$

Here, η denotes a luminescence efficiency, π denotes the ratio of the circumference of a circle to its diameter, S denotes a display area, B denotes a luminance, W denotes a power consumption, and V and I denote a voltage and a current, respectively.

Theoretically, luminescence efficiency can be increased by increasing the pressure of a discharge gas and a distance between electrodes. However, when the pressure and the distance are increased, a discharge voltage increases, and thus a driving integrated chip (IC) having a high withstand voltage is required. As a result, the price of products is increased. Conversely, if the pressure of a discharge gas and the distance between electrodes are decreased in order to avoid these problems, luminance and luminescent efficiency are decreased, which is worse than an increase in the price.

Therefore, in most of the conventional flat lamps, the pressure of a discharge gas is high, and the distance between electrodes is wide, and thus a discharge voltage is high. One kind of these lamps is shown in FIG. 1.

In the case of a flat lamp as shown in FIG. 2, since an igniter is provided on the back surface of a front glass substrate, a discharge voltage is lower than the flat lamp shown in FIG. 1. However, as described above, luminance is decreased. Since the luminance B is proportional to the luminescence efficiency η, as shown in the above formula, a discharge voltage can be lowered, but luminescence efficiency is degraded in the flat lamp shown in FIG. 2.

SUMMARY OF THE INVENTION

The present invention provides a flat lamp for a flat display, which prevents degradation of luminescence efficiency and allows a low-voltage discharge.

The present invention also provides a method of driving the flat lamp.

According to an aspect of the present invention, there is provided a flat lamp including a front panel and a rear panel, which are spaced a predetermined distance apart from each other and hermetically sealed, and a spacer, which is provided between the front panel and the rear panel to maintain the front and rear panels separated by the predetermined distance and secure a discharge space, wherein a predetermined discharge gas exists in the discharge space, and a fluorescent layer is formed on an inner surface of at least one of the front and rear panels. The flat lamp comprises a plurality of electrode groups in the rear panel, each electrode group comprising at least three electrodes.

When each of the electrode groups is composed of three electrodes, two of them are used to sustain a discharge, and the other one functions as an igniter for decreasing a discharge voltage.

Preferably, the rear panel comprises a rear glass substrate which is provided with the electrode groups, a dielectric layer which is formed on the rear glass substrate to cover the electrode groups, and a fluorescent layer formed on the dielectric layer.

Preferably, the front panel comprises a front glass substrate, a dielectric layer which is formed on a back surface of the front glass substrate, and a fluorescent layer formed on a back surface of the dielectric layer.

Preferably, the fluorescent layer is formed on the inner surface of the front panel and/or rear panel.

Preferably, the front panel comprises a plurality of electrodes, and at least one of the electrodes corresponds to a single electrode group.

Preferably, the electrodes constituting each of the electrode groups are arranged in a striped pattern and have a straight line shape, a sine-wave shape, a sawtooth shape, or a square-wave shape.

Preferably, a gap between a particular electrode among the electrodes constituting each of the electrode groups and an adjacent electrode thereamong is different from a gap between all of the electrodes except for the particular electrode thereamong.

According to another aspect of the present invention, there is provided a flat lamp including a front panel and a rear panel, which are spaced a predetermined distance apart from each other and hermetically sealed, and a spacer, which is provided between the front panel and the rear panel to maintain the front and rear panels separated by the predetermined distance and secure a discharge space, wherein a predetermined discharge gas exists in the discharge space, and a fluorescent layer is formed on a surface of at least one of the front and rear panels, the surface being exposed to the discharge space. The flat lamp comprises a plurality of electrodes in each of the front and rear panels, wherein the plurality of electrodes are arranged such that at least three electrodes, which are selected partially from the plurality of electrodes included in the rear panel and partially from the plurality of electrodes included in the front panel, constitute a single electrode set.

Preferably, the single electrode set comprises at least two electrodes selected from the plurality of electrodes included in the rear panel and at least one electrode selected from the plurality of electrodes included in the front panel to correspond to the at least two electrodes. Alternatively, the single electrode set may comprise at least two electrodes selected from the plurality of electrodes included in the front panel and at least one electrode selected from the plurality of electrodes included in the rear panel to correspond to the at least two electrodes. The structure of the front and rear panels and the shape of the electrodes are the same as those described above. Alternatively, the front panel may comprise a front glass substrate, and a dielectric layer which is formed on a back surface of the front glass substrate. The plurality of electrodes included in the front panel may be formed between the front glass substrate and the dielectric layer.

According to still another aspect of the present invention, there is provided a method of driving a flat lamp including a front panel and a rear panel, which are spaced a predetermined distance apart from each other and hermetically sealed, and a spacer, which is provided between the front panel and the rear panel to maintain the front and rear panels separated by the predetermined distance and secure a discharge space, wherein a predetermined discharge gas exists in the discharge space, a fluorescent layer is formed on an inner surface of at least one of the front and rear panels, and a plurality of electrode groups each comprising first, second, and third electrodes are provided in the rear panel. The method comprises applying a first voltage to a first selected electrode among the first through third electrodes, taking account of a wall charge distribution and a space charge distribution, which were formed previously; applying a second voltage to a second selected electrode adjacent to the first selected electrode among the first through third electrodes, taking account of a wall charge distribution and a space charge distribution, which result from the application of the first voltage; applying a third voltage to the first selected electrode, taking account of a wall charge distribution and a space charge distribution, which result from the application of the second voltage; and applying a fourth voltage to an unselected electrode among the first through third electrodes.

Preferably, the first voltage has the same polarity as a wall charge previously induced in the first selected electrode. Preferably, the second voltage has an opposite polarity to the first voltage. Preferably, the third voltage has the same polarity as the second voltage. Preferably, the fourth voltage has an opposite polarity to the third voltage.

The first and second selected electrodes are the second and third electrodes, respectively.

According to still another aspect of the present invention, there is provided a method of driving a flat lamp including a front panel and a rear panel, which are spaced a predetermined distance apart from each other and hermetically sealed, and a spacer, which is provided between the front panel and the rear panel to maintain the front and rear panels separated by the predetermined distance and secure a discharge space, wherein a predetermined discharge gas exists in the discharge space, a fluorescent layer is formed on an inner surface of at least one of the front and rear panels, and a plurality of electrode groups each comprising first, second, third, and fourth electrodes are provided in the rear panel. The method comprises inducing a discharge between a first selected electrode and an adjacent second selected electrode among the first through fourth electrodes; applying a first voltage to the second selected electrode, taking account of a wall charge distribution and a space charge distribution, which result from the discharge; applying a second voltage to a third selected electrode adjacent to the second selected electrode, taking account of a wall charge distribution and a space charge distribution, which result from the application of the first voltage; applying a third voltage to an unselected electrode among the first through fourth electrodes, taking account of a wall charge distribution and a space charge distribution, which result from the application of the second voltage; applying a fourth voltage to the third selected electrode, taking account of a wall charge distribution and a space charge distribution, which result from the application of the third voltage; and applying a fifth voltage to the second selected electrode, taking account of a wall charge distribution and a space charge distribution, which result from the application of the fourth voltage.

Preferably, the first voltage has the same polarity as a wall charge induced by the discharge. Preferably, the second voltage has an opposite polarity to the first voltage. Preferably, the third voltage has an opposite polarity to the second voltage. Preferably, the fourth voltage has the same polarity as the third voltage. Preferably, the fifth voltage has an opposite polarity to the fourth voltage.

According to the present invention, a discharge starting voltage can be decreased, luminescence efficiency can also be prevented from decreasing.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
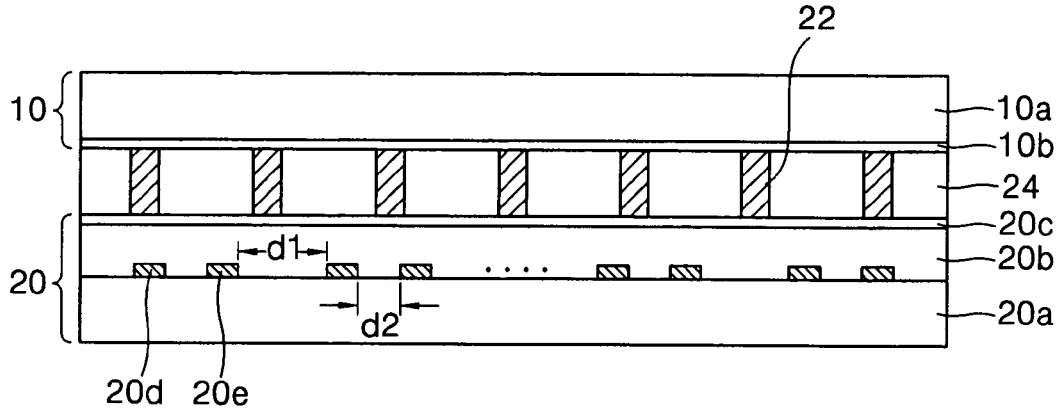
FIG. 1 (PRIOR ART)
FIG. 1 is a cross-section of a conventional flat lamp.
Figure 2:
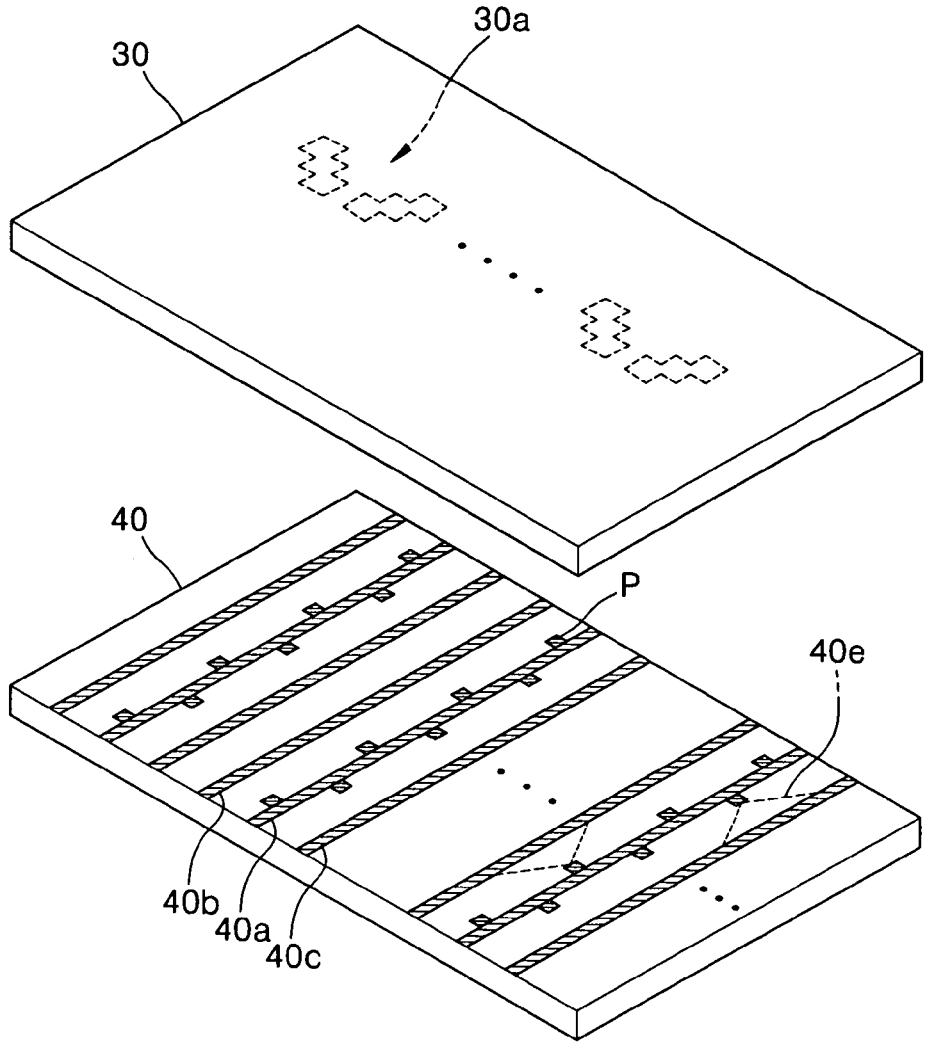
FIG. 2 (PRIOR ART)
FIG. 2 is a perspective view of another conventional flat lamp.

Hereinafter, preferred embodiments of the present invention will be described in detail with reference to the attached drawings. In the drawings, the thicknesses of layers and regions are exaggerated for clarity.

<First Embodiment>

Figure 3:
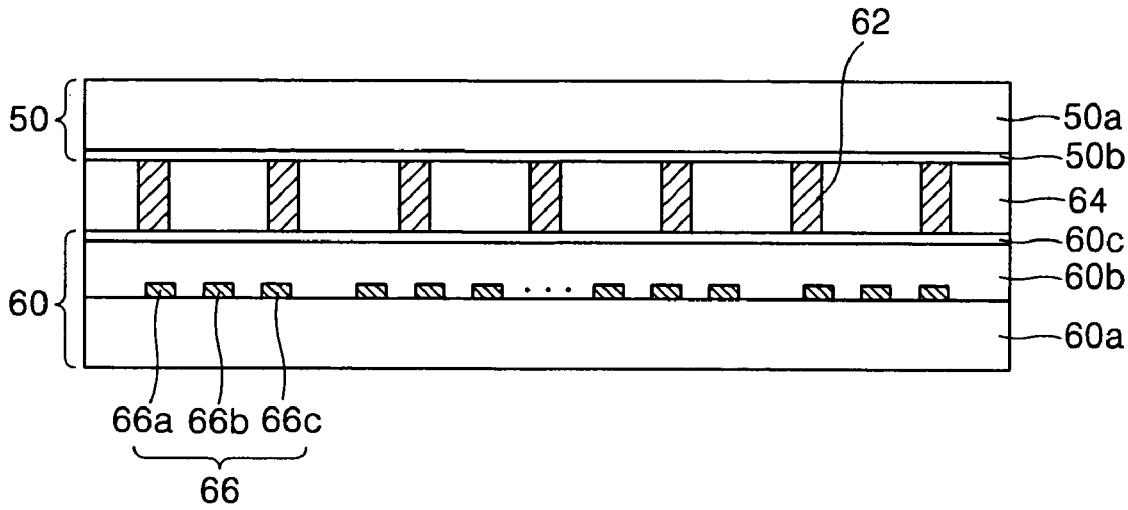
FIG. 3 is a cross-section of a flat lamp according to a first embodiment of the present invention.

As shown in FIG. 3, a flat lamp according to the first embodiment of the present invention includes a first front panel 50 and a first rear panel 60, which face each other and are hermetically sealed; and spacers 62 provided in a discharge space 64 between the first front panel 50 and the first rear panel 60. The spacers 62 serve to maintain the first front panel 50 and the first rear panel 60 separated from each other by a predetermined distance. The first front panel 50 includes a first front glass substrate 50*a* and a first front fluorescent layer 50*b* formed on the back surface of the first front glass substrate 50*a*. The first front panel 50 may further include a first front dielectric layer (not shown) between the first front glass substrate 50*a* and the first front fluorescent layer 50*b*. The first rear panel 60 includes a first rear glass substrate 60*a*, a first electrode group 66 formed in a striped pattern on the first rear glass substrate 60*a*, a first rear dielectric layer 60*b* formed on the first rear glass substrate 60*a* to cover the first electrode group 66, and a first rear fluorescent layer 60*c* formed on the first rear dielectric layer 60*b*.

The first electrode group 66 is composed of three electrodes 66*a*, 66*b*, and 66*c* spaced a predetermined distance apart. A plurality of first electrode groups 66 are arranged on the first rear glass substrate 60*a* spaced a predetermined distance apart. The predetermined distance among the plurality of first electrode groups 66 is greater than the predetermined distance among the three electrodes 66*a*, 66*b*, and 66*c* in each first electrode group 66. The features of the first electrode group 66 are clearly understood with reference to FIG. 4, which shows only the first rear glass substrate 60*a* and the plurality of first electrode groups 66 separated from FIG. 3.

<Second Embodiment>

In the first and second embodiments, the same reference numerals denote the same elements, and descriptions of the same elements will be omitted.

Figure 5:
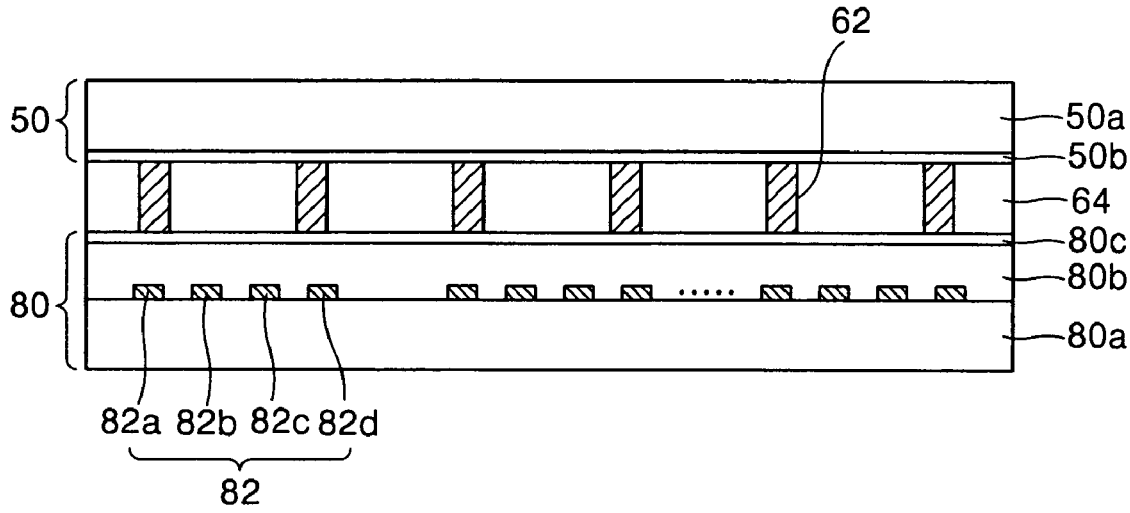
FIGS. 5 through 7 are cross-sections of flat lamps according to second through fourth embodiments, respectively.

Referring to FIG. 5, a flat lamp according to the second embodiment of the present invention includes the first front panel 50, a second rear panel 80, and the spacers 62 provided in the discharge space 64 between the first front panel 50 and the second rear panel 80 to maintain the first front panel 50 and the second rear panel 80 separated from each other by a predetermined distance. The second rear panel 80 includes a second rear glass substrate 80*a*; a second rear dielectric layer 80*b* and a second rear fluorescent layer 80*c*, which are sequentially stacked on the second rear glass substrate 80*a*; and a second electrode group 82 provided between the second rear glass substrate 80*a* and the second rear dielectric layer 80*b*. The second electrode group 82 is composed of four electrodes 82*a*, 82*b*, 82*c*, and 82*d* in parallel, which are spaced a predetermined distance apart in a striped pattern. A plurality of second electrode groups 82 are arranged between the second rear glass substrate 80*a* and the second rear dielectric layer 80*b*. It is preferable that the predetermined distance among the plurality of second electrode groups 82 is greater than the predetermined distance among the four electrodes 82*a*, 82*b*, 82*c*, and 82*d* in each second electrode group 82.

In the first and second embodiments, discharges can be induced at low voltages without degrading luminescence efficiency by sequentially applying voltages to the first and second electrode groups 66 and 82 taking account of previously formed wall charges. This will be described later with respect to a method of driving the flat lamp.

<Third Embodiment>

Figure 6:
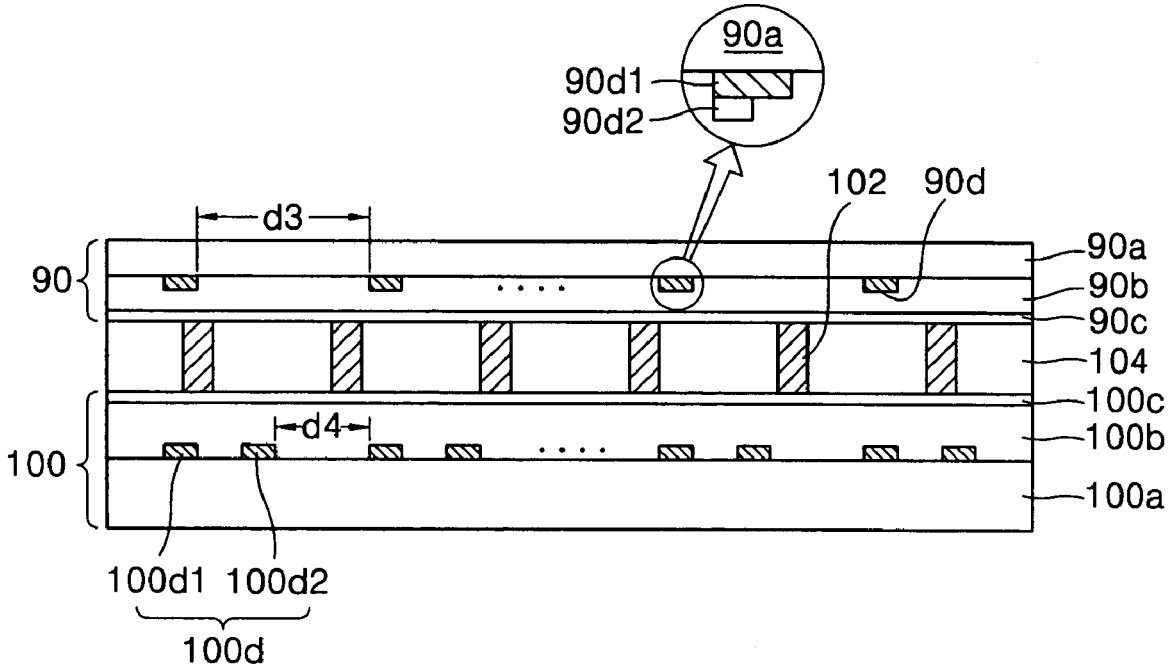

Referring to FIG. 6, a flat lamp according to the third embodiment of the present invention includes a second front panel 90, a third rear panel 100, and spacers 102 provided in a discharge space 104 between the second front panel 90 and the third rear panel 100. The spacers 102 support the second front panel 90 and the third rear panel 100 and maintain the second front panel 90 and the third rear panel 100 separated from each other by a predetermined distance. The second front panel 90 includes a second front glass substrate 90*a*, front electrodes 90*d* formed on the back surface of the second front glass substrate 90*a*, a second front dielectric layer 90*b* formed on the back surface of the second front glass substrate 90*a* to cover the front electrodes 90*d*, and a second front fluorescent layer 90*c* formed on the back surface of the second front dielectric layer 90*b*. The second front dielectric layer 90*b* primarily serves to control a discharge current using wall charges and secondarily serves to prevent the front electrodes 90*d* from being damaged by charged particles generated during a discharge. It is preferable that the second front dielectric layer 90*b* is made of a transparent material having low absorption to visual light. The front electrodes 90*d* are arranged in a striped pattern and in a one-to-one correspondence with third electrode groups 100*d* formed on the third rear panel 100. Accordingly, the number of front electrodes 90*d* may be the same as the number of third electrode groups 100*d*. One among the front electrodes 90*d* and a corresponding third electrode group 100*d* form an electrode set for inducing a discharge in the discharge space 104 between the second front panel 90 and the third rear panel 100. Each of the third electrode groups 100*d* is composed of two electrodes 100*d*1 and 100*d*2. Accordingly, a single electrode set is composed of three electrodes, i.e., a single front electrode 90*d* included in the second front panel 90 and two electrodes included in the third rear panel 100. As described above, the front electrodes 90*d* included in the second front panel 90 and the third electrode groups 100*d* included in the third rear panel 100 form a plurality of electrode sets. Since it is preferable that each electrode set is independently driven without being influenced by adjacent electrode sets, it is preferable that the front electrodes 90*d* are spaced an appropriate distance d3 apart, and that the third electrode groups 100*d* are spaced a predetermined distance d4 apart. In each electrode set, a single front electrode 90*d* faces a single third electrode group 100*d*. Since each third electrode group 100*d* is composed of the two electrodes 100*d*1 and 100*d*2, the single front electrode 90*d* actually faces the two electrodes 100*d*1 and 100*d*2. Accordingly, it is preferable that the distance d3 among the front electrodes 90*d* is greater than the distance d4 among the third electrode groups 100*d*.

As shown in an enlarged view circled in FIG. 6, it is preferable that each of the front electrodes 90*d* is composed of a transparent electrode 90*d*1, e.g., indium tin oxide (ITO) electrode, on the back surface of the second front glass substrate 90*a* and a bus electrode 90*d*2 on the back surface of the transparent electrode 90*d*1. It is preferable that the second front dielectric layer 90*b* is a single layer, as shown in FIG. 6, but the second front dielectric layer 90*b* may be a multilayer.

The third rear panel 100 includes a third rear glass substrate 100*a*, the plurality of third electrode groups 100*d* arranged in a striped pattern on the third rear glass substrate 100*a*, a third rear dielectric layer 100*b* stacked on the third rear glass substrate 100*a* to cover the third electrode groups 100*d*, and a third rear fluorescent layer 100*c* formed on the third rear dielectric layer 100*b*. Like the second front dielectric layer 90*b*, the third rear dielectric layer 100*b* protects the third electrode groups 100*d* during discharges. Each of the third electrode groups 100*d* is composed of the two electrodes 100*d*1 and 100*d*2 but may be composed of more than two electrodes, for example, three electrodes. When each third electrode group 100*d* is composed of three electrodes, a single electrode set is composed of four electrodes, i.e., a single front electrode 90*d* and three electrodes of a corresponding third electrode group 100*d*.

<Fourth Embodiment>

Figure 7:
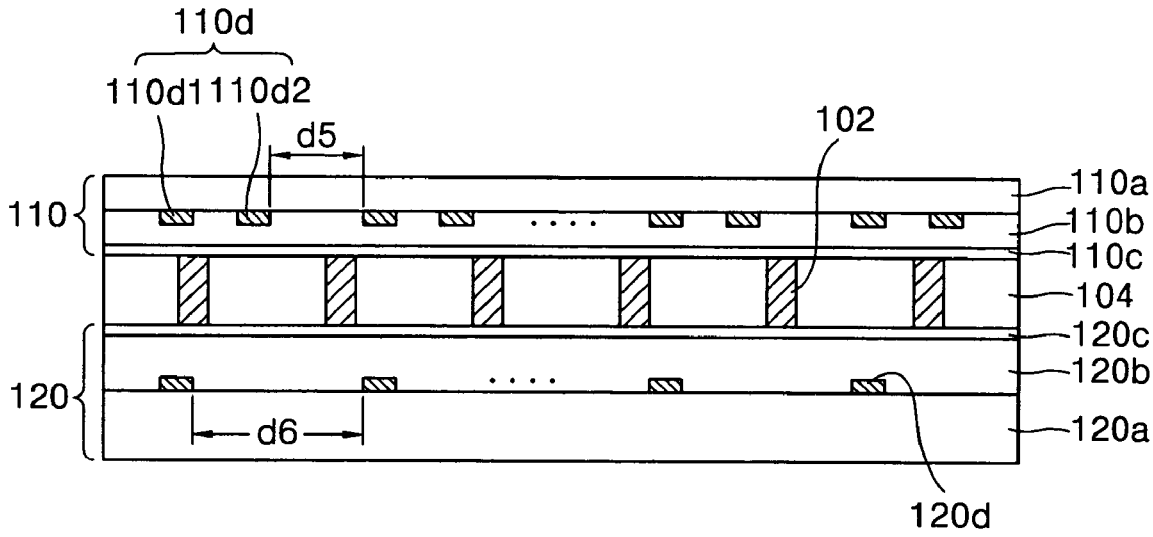

Referring to FIG. 7, a flat lamp according to the fourth embodiment of the present invention includes a third front panel 110, a fourth rear panel 120 exactly facing the third front panel 110 and being hermetically sealed thereto, and spacers 102 provided in a discharge space 104 between the third front panel 110 and the fourth rear panel 120. The spacers 102 are the same as those included in one of 30 the flat lamps according to the first through third embodiments. The third front panel 110 includes a third front glass substrate 110*a*, a third front dielectric layer 110*b* formed on the back surface of the third front glass substrate 110*a*, a third front fluorescent layer 110*c* formed on the back surface of the third front dielectric layer 110*b*, and a fourth electrode group 110*d* provided between the third front glass substrate 110*a* and the third front dielectric layer 110*b*. The third front dielectric layer 110*b* preferably has the same features and structure as the second front dielectric layer (90*b* in FIG. 6) of the third embodiment. The fourth electrode group 110*d* is composed of two electrodes 110*d*1 and 110*d*2 arranged in a striped pattern in parallel. A plurality of fourth electrode groups 110*d* are arranged between the third front glass substrate 110*a* and the third front dielectric layer 110*b*. It is preferable that the two electrodes 110*d*1 and 110*d*2 of each fourth electrode group 110*d* have the same features and structure as the front electrode (90*d* in FIG. 6) of the third embodiment, and thus descriptions thereof will be omitted. However, since each fourth electrode group 110*d* composed of two electrodes is in a one-to-one correspondence with a rear electrode 120*d* included in the fourth rear panel 120, it is preferable that a distance d5 among the fourth electrode groups 110*d* is less than a distance d6 among a plurality of rear electrodes 120*d*.

The fourth rear panel 120 includes a fourth rear glass substrate 120*a*, a fourth rear dielectric layer 120*b* stacked on the fourth rear glass substrate 120*a*, a fourth rear fluorescent layer 120*c* formed on the fourth rear dielectric layer 120*b*, and the plurality of rear electrodes 120*d* provided between the fourth rear glass substrate 120*a* and the fourth rear dielectric layer 120*b*. The rear electrodes 120*d* are arranged in a striped pattern. The plurality of fourth electrode groups 110*d* included in the third front panel 110 and the plurality of rear electrodes 120*d* included in the fourth rear panel 120 form a plurality of electrode sets. In other words, a single rear electrode 120*d* and a corresponding fourth electrode group 110*d* forms a single electrode set. Discharges can be induced at a low voltage without degrading luminescence efficiency by sequentially applying a voltage to the electrode sets taking account of wall charges.

The following description concerns simulations of the flat lamps according to the first and second embodiments, respectively, and the results of the simulations.

In the simulations, a flat lamp including an electrode group composed of three electrodes on a rear panel (hereinafter, referred to as a first simulation flat lamp) was manufactured to correspond to the flat lamp according to the first embodiment, and a flat lamp including an electrode group composed of four electrodes on a rear panel (hereinafter, referred to as a second simulation flat lamp) was manufactured to correspond to the flat lamp according to the second embodiment. In addition, for comparison, a flat lamp including an electrode group composed of two electrodes on a rear panel (hereinafter, referred to as a third simulation flat lamp) was manufactured to correspond to the conventional flat lamp shown in FIG. 1.

Figure 8:
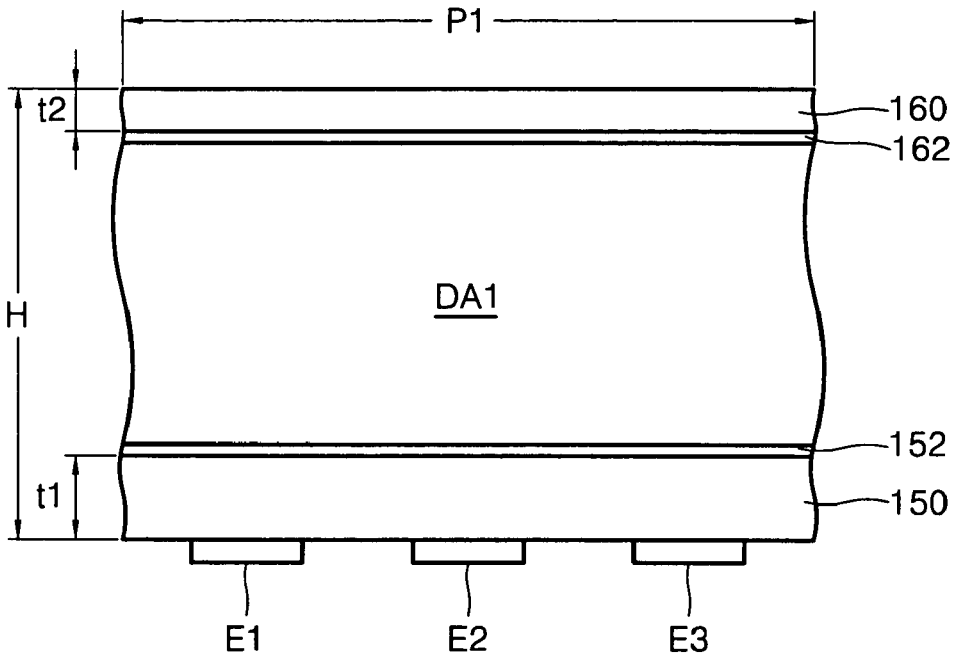
FIG. 8 is a cross-section of a 3-electrode simulation flat lamp used in a simulation of the flat lamp according to the first embodiment of the present invention.
Figure 9:
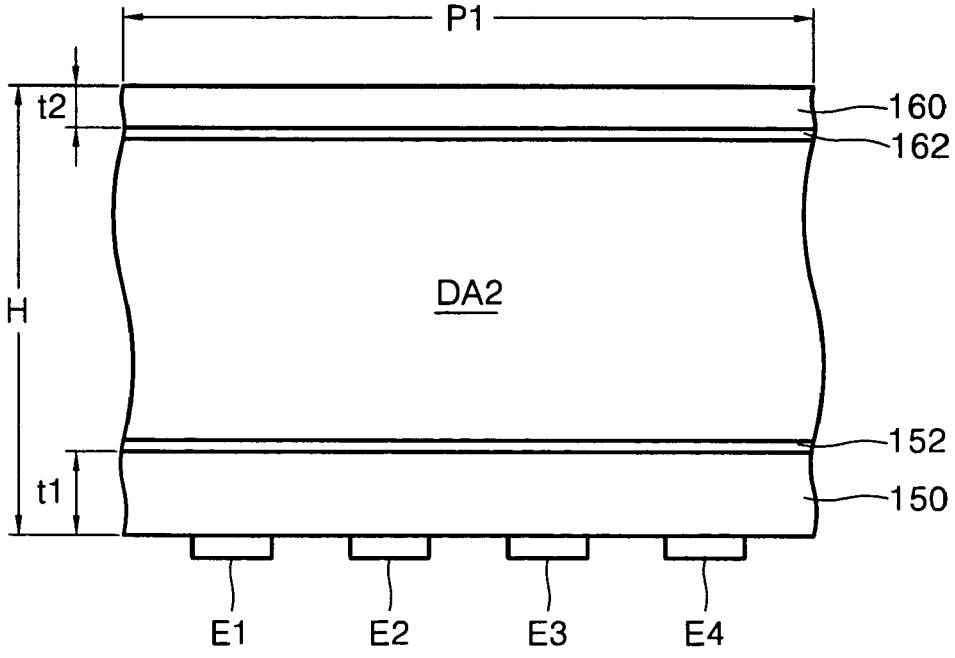
FIG. 9 is a cross-section of a 4-electrode simulation flat lamp used in a simulation of the flat lamp according to the second embodiment of the present invention.

FIGS. 8 and 9 are cross-sections respectively showing major parts of the first and second simulation flat lamps.

In FIGS. 8 and 9, reference numeral 150 denotes a rear dielectric layer included in the rear panel, and reference numeral 152 denotes a fluorescent layer formed on the rear dielectric layer 150. In FIG. 8, reference characters E1, E2, and E3 denote first through third electrodes constituting a single electrode group (hereinafter, referred to as a first simulation electrode group) included in the rear panel of the first simulation flat lamp. In FIG. 9, reference characters E1, E2, E3, and E4 denote first through fourth electrodes constituting a single electrode group (hereinafter, referred to as a second simulation electrode group) included in the rear panel of the second simulation flat lamp. Although not shown, the first and second simulation electrode groups are repeatedly formed in a horizontal direction. A reference character P1 denotes a period with which the first and second simulation electrode groups are repeated. In the first simulation flat lamp, a discharge cell corresponds to an area defined by a first simulation electrode group. Accordingly, the period P1 of the first simulation electrode groups is equal to a period of discharge cells, that is, a cell pitch. Therefore, hereinafter, it is assumed that the reference character P1 denotes a cell pitch. Reference numeral 160 denotes a front dielectric layer separated above the rear panel by a predetermined distance. Reference numeral 162 denotes a front fluorescent layer formed on the back surface of the front dielectric layer 160. A reference character DA1 denotes a discharge space in the first simulation flat lamp. A reference character DA2 denotes a discharge space in the second simulation flat lamp. A reference character H denotes a height of the discharge cell defined by an electrode group. Reference characters t1 and t2 denote the thicknesses of the rear dielectric layer 150 and the front dielectric layer 160, respectively. Table 1 shows the simulation conditions for the first and second simulation flat lamps.

TABLE 1

| Item | Value | Note |
|---|---|---|
| Discharge gas/Pressure | Xe/10 torr | |
| Cell height H | 1 mm | Including the thicknesses of the front and rear dielectric layers |
| Cell pitch P1 | 10 mm | |
| Number of grids in a direction of the cell height H | 100 | |
| Number of grids in a direction of the cell pitch P1 | 100 | |
| Temperature of the discharge gas | 300° K | |
| Secondary electron emission coefficient of a dielectric layer for the discharge gas (Xe) | 0.00333 | |
| Acceleration parameter | 3 | |
| Boundary condition | Symmetric | |
| Initial ion density | $10^4/cm^3$ | |
| Thickness t1 of the rear dielectric layer | 100 μm | |
| Thickness t2 of the front dielectric layer | 10 μm | |
| Dielectric constant of the rear dielectric layer | 15 | |
| Dielectric constant of the front dielectric layer | 5 | |

The discharge simulations of the first through third simulation flat lamps were performed under the conditions shown in Table 1. In the discharge simulations, three sequences were performed with a period of 30 μs so that a pulse voltage was applied to the electrodes included in the first through third simulation flat lamps for a total of 90 μs. During the sequences, a voltage at which a discharge was stable was set as a discharge voltage. A voltage pulse having a square-wave shape was applied to the electrodes, but the shape of the voltage pulse may be changed.

The following description concerns the discharge simulation of the third simulation flat lamp.

Figure 10:
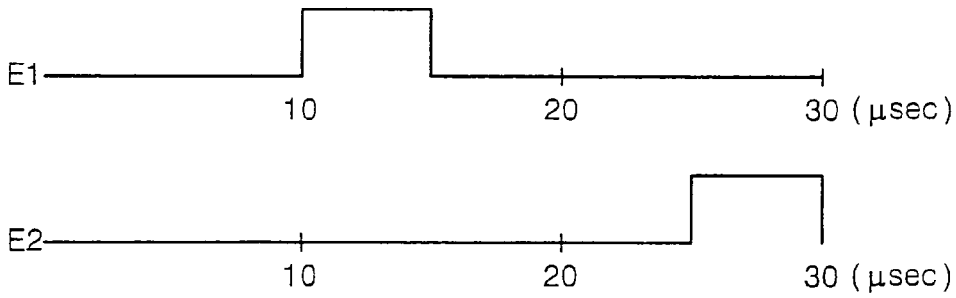
FIG. 10 (PRIOR ART)
FIG. 10 is a timing chart of a driving simulation of a conventional 2-electrode flat lamp.

Table 2 shows a sequence of the discharge simulation of the third simulation flat lamp (hereinafter, referred to as a third sequence). FIG. 10 is a timing chart showing voltage pulses, which are respectively applied to a simulation electrode group (composed of two electrodes E1 and E2) included in the third simulation flat lamp during the third sequence.

TABLE 2

| Pulse number | Duration (μs) | First electrode voltage | Second electrode voltage |
|---|---|---|---|
| 1 | 10.00 | 0.00 | 0.00 |
| 2 | 5.00 | 500.00 | 0.00 |
| 3 | 10.00 | 0.00 | 0.00 |
| 4 | 5.00 | 0.00 | 500.00 |

In Table 2, the "first electrode voltage" and the "second electrode voltage" respectively indicate voltages applied to the first and second electrodes E1 and E2 constituting the simulation electrode group during the third sequence.

As shown in Table 2, no voltage was applied to either the first electrode E1 or the second electrode E2 for 10 μs since the commencement of the third sequence. Thereafter, a pulse voltage of 500 V was applied to the first electrode E1 for 5 μs, and then voltage was not applied to either the first electrode E1 or the second electrode E2 for 10 μs again. Subsequently, a pulse voltage of −500 V was applied to the second electrode E2 for the last 5 μs of the third sequence. Thereafter, two more third sequences were performed.

FIG. 10 clearly shows a start instant where a pulse voltage was applied to each of the first and second electrodes E1 and E2, and the shape and duration of each pulse voltage, for 30 μs while the third sequence was performed.

The following description concerns the discharge simulation of the first simulation flat lamp.

Figure 11:
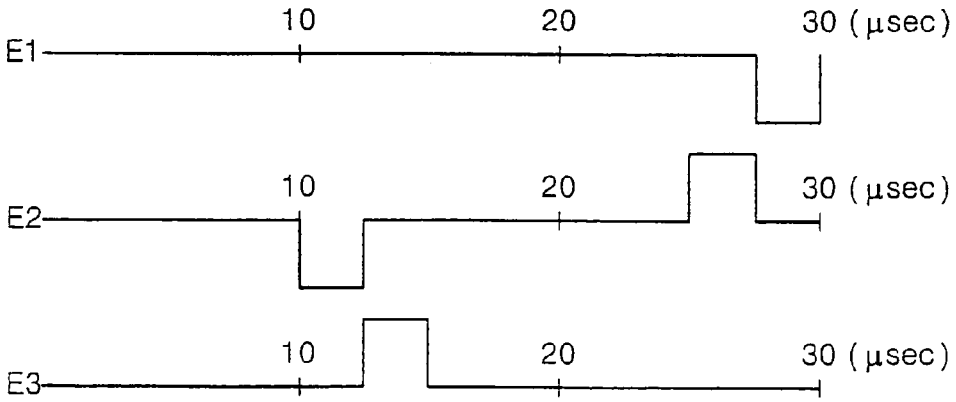
FIG. 11 is a timing chart of a driving simulation of the flat lamp according to the first embodiment.

Table 3 shows a sequence of the discharge simulation of the first simulation flat lamp (hereinafter, referred to as a first sequence). FIG. 11 is a timing chart showing voltage pulses, which are respectively applied to the three electrodes E1, E2, and E3 constituting the first simulation electrode group included in the first simulation flat lamp, based on Table 3.

TABLE 3

| Pulse number | Duration (μs) | First electrode voltage | Second electrode voltage | Third electrode voltage |
|---|---|---|---|---|
| 1 | 10.00 | 0.00 | 0.00 | 0.00 |
| 2 | 2.50 | 0.00 | −500.00 | 0.00 |
| 3 | 2.50 | 0.00 | 0.00 | 500.00 |
| 4 | 10.00 | 0.00 | 0.00 | 0.00 |
| 5 | 2.50 | 0.00 | 500.00 | 0.00 |
| 6 | 2.50 | −500.00 | 0.00 | 0.00 |

As shown in Table 3 and FIG. 11, in order to make the sequence conditions for all of the simulation flat lamps the same, no voltage was applied to any of the first through third electrodes E1 through E3 for 10 μs since the commencement of the first sequence. Thereafter, a pulse voltage of −500 V was applied to only the second electrode E2 for 2.5 μs. Subsequently, a pulse voltage of 500 V was applied to only the third electrode E3 for 2.5 μs. Thereafter, no voltage was applied to any of the first through third electrodes E1 through E3 for 10 μs. Thereafter, a pulse voltage of 500 V was applied to only the second electrode E2 for 2.5 μs. Next, a pulse voltage of −500 V was applied to only the first electrode E1 for the last 2.5 μs of the first sequence. Thereafter, two more first sequences were performed.

The following description concerns the discharge simulation of the second simulation flat lamp.

Figure 12:
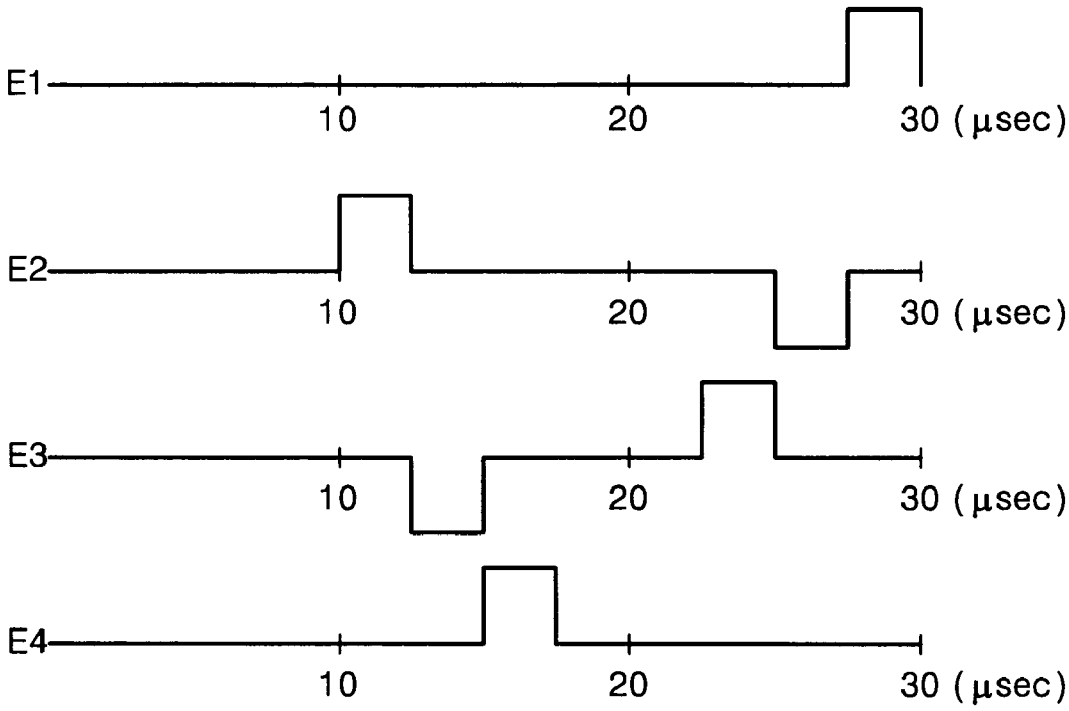
FIG. 12 is a timing chart of a driving simulation of the flat lamp according to the second embodiment.

Table 4 shows a sequence of the discharge simulation of the second simulation flat lamp (hereinafter, referred to as a second sequence). FIG. 12 is a timing chart showing voltage pulses, which are respectively applied to the four electrodes E1, E2, E3, and E4 constituting the second simulation electrode group included in the second simulation flat lamp, based on Table 3.

TABLE 4

| Pulse number | Duration (μs) | First electrode voltage | Second electrode voltage | Third electrode voltage | Fourth electrode voltage |
|---|---|---|---|---|---|
| 1 | 10.00 | 0.00 | 0.00 | 0.00 | 0.00 |
| 2 | 1.70 | 0.00 | 500.00 | 0.00 | 0.00 |
| 3 | 1.70 | 0.00 | 0.00 | −500.00 | 0.00 |
| 4 | 1.70 | 0.00 | 0.00 | 0.00 | 500.00 |
| 5 | 10.00 | 0.00 | 0.00 | 0.00 | 0.00 |
| 6 | 1.70 | 0.00 | 0.00 | 500.00 | 0.00 |
| 7 | 1.70 | 0.00 | −500.00 | 0.00 | 0.00 |
| 8 | 1.70 | 500.00 | 0.00 | 0.00 | 0.00 |

As shown in Table 4 and FIG. 12, no voltage was applied to any of the first through fourth electrodes E1 through E4 for the first 10 μs of the second sequence. Thereafter, a pulse voltage of 500 V was applied to only the second electrode E2 for 1.70 μs, and for the next 1.70 μs a pulse voltage of −500 V was applied to only the third electrode E3. For the next 1.70 μs, a pulse voltage of 500 V was applied to only the fourth electrode E4. For the next 10 μs, voltage was not applied to any of the first through fourth electrodes E1 through E4. Thereafter, pulse voltages of 500 V, −500 V, and 500 V was sequentially applied to the third electrode E3, the second electrode E2, and the first electrode E1, and each application was performed for 1.70 μs. Thereafter, two more second sequences were performed.

In the discharge simulations of the first and second simulation flat lamps, pulse voltages of different polarities were sequentially applied to the electrodes, taking account of a predetermined potential difference (i.e., a predetermined wall voltage) between the electrodes due to wall charges having been induced on the surface of the rear dielectric layer (150 in FIGS. 8 and 9) covering the electrodes by a previously applied pulse voltage. Accordingly, when the distribution of wall charges is reversed, the polarity of a pulse voltage applied to each electrode is also reversed. For example, if the distribution of initial wall charges is reversed in the first simulation flat lamp, an initial pulse voltage applied to the second electrode E2 is 500 V, not −500 V. In addition, according to the distribution of wall charges, it may be the first or third electrode E1 or E3, not the first electrode E1, to which a pulse voltage is initially applied.

Figure 13:
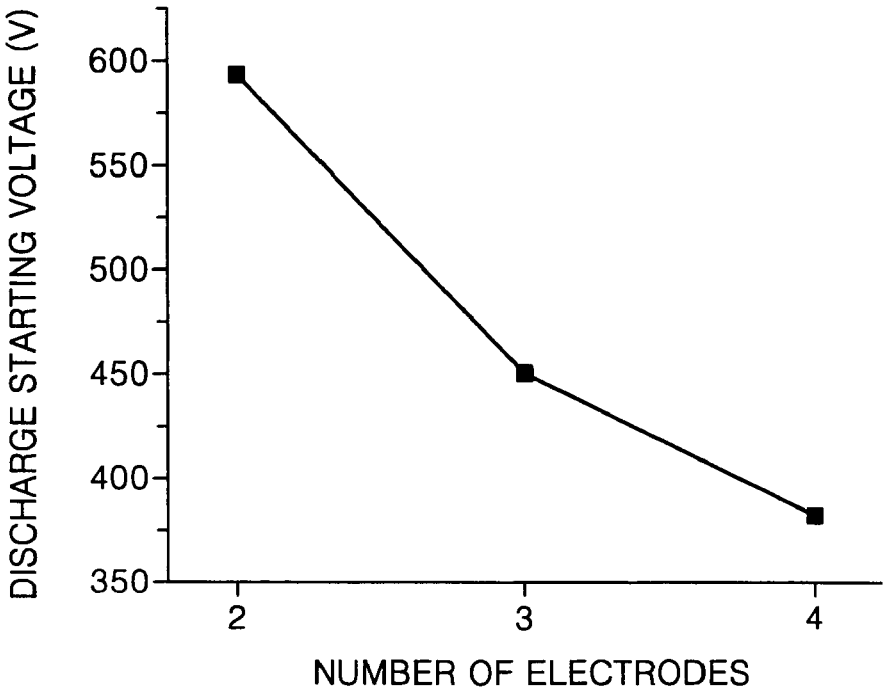
FIG. 13 is a graph showing the results of the simulations of the flat lamps according to the first and the second embodiments, respectively.

FIG. 13 shows the results of measuring discharge voltages when discharges were stabilized since the discharge simulations of the first through third simulation flat lamps had been performed.

In FIG. 13, the horizontal axis indicates the number of electrodes constituting each of the first through third simulation electrode groups respectively included in the first through third simulation flat lamps. The vertical axis indicates a voltage when a discharge is stabilized, that is, a minimum discharge voltage.

Referring to FIG. 13, when the number of electrodes constituting a simulation electrode group was two, that is, in the third simulation flat lamp corresponding to the conventional flat lamp, a discharge starting voltage or a minimum discharge voltage was about 550–600 V. When the number of electrodes constituting a simulation electrode group was three, that is, in the first simulation flat lamp corresponding to the flat lamp according to the first embodiment of the present invention, a minimum discharge voltage was about 450 V. When the number of electrodes constituting a simulation electrode group was four, that is, in the second simulation flat lamp corresponding to the flat lamp according to the second embodiment of the present invention, a minimum discharge voltage was less than 400 V.

Consequently, when an electrode group included in a flap lamp is composed of at least three electrodes, a discharge starting voltage (i.e., a minimum discharge voltage) can be linearly decreased by adjusting an order in which a pulse voltage is applied to the electrodes and the polarity of the pulse voltage taking account of wall charges. This feature applies to a case where an electrode group is composed of at least four electrodes.

The following description concerns a method of driving a flat lamp manufactured according to the present invention and having wall charges, that is, a method of sequentially applying a pulse voltage to electrodes taking account of the influence of wall charges induced by a previously applied pulse voltage on the surface of a dielectric layer covering the electrodes. For clarity of the description, a flat lamp having an electrode group composed of three electrodes, like the flat lamp according to the first embodiment of the present invention, will be exemplified.

FIGS. 14 through 17 are cross-sections of the sequential changes in the distribution of wall charges depending on a voltage sequentially applied to three electrodes in the flat lamp. In FIGS. 14 through 17, reference numeral 200 denotes a rear dielectric layer covering first through third electrodes E1, E2, and E3 constituting a single electrode group. Reference characters e1, e2, and e3 denote first through third wall charges, respectively, induced on predetermined regions on the dielectric layer 200, which respectively correspond to the first through third electrodes E1, E2, and E3.

Figure 14:
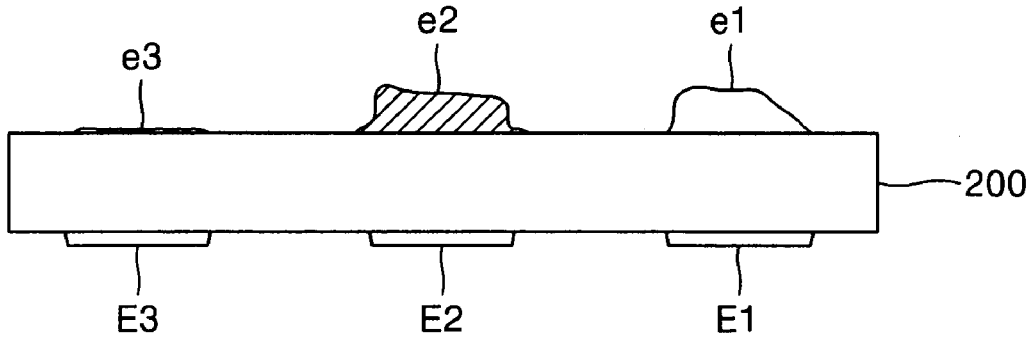
FIGS. 14 through 17 are cross-sections of changes in the distribution of wall charges on the surface of a dielectric layer covering electrodes when a voltage is sequentially applied to the electrodes in the flat lamp according to the first embodiment of the present invention.
Figure 15:
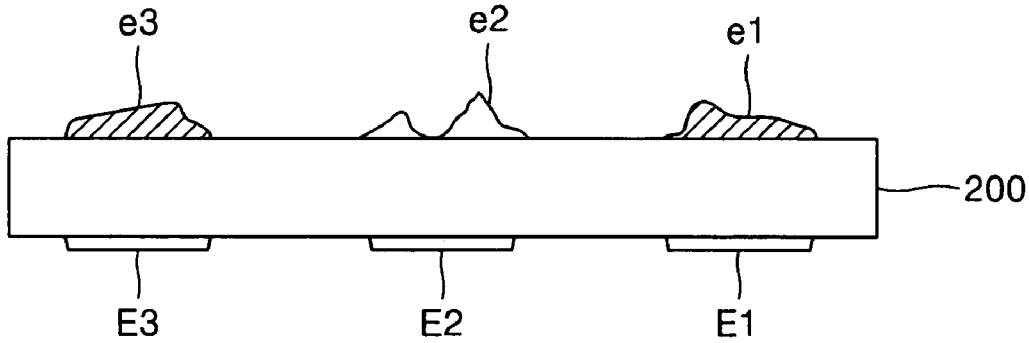
Figure 16:
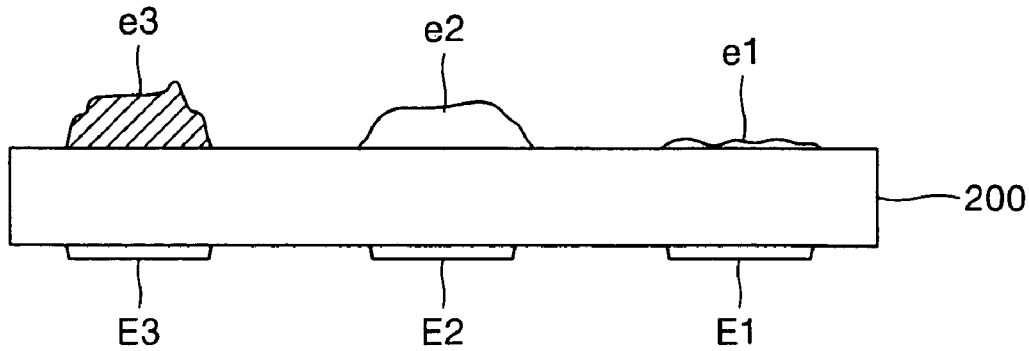

FIG. 14 shows the distribution of wall charges induced by a voltage applied in a previous discharge sequence, immediately before another discharge sequence. Referring to FIG. 14, a large amount of first and second wall charges e1 and e2 exist on the dielectric layer 200 while the amount of the third wall charge e3 is very slight. The first wall charge e1 is negative while the second wall charge e2 is positive. Accordingly, there is a potential difference between the first and second wall charges e1 and e2. Such a potential difference is called a wall voltage. When a pulse voltage is applied to the second electrode E2 at the beginning of a new discharge sequence due to the first through third wall charges e1, e2, and e3, the pulse voltage applied to the second electrode E2 can be decreased by the potential difference.

In the meantime, when the distribution of the first through third wall charges e1 through e3 on the dielectric layer 200 is different from that shown in FIG. 14, for example, when the first wall charge e1 is positive while the second wall charge e2 is negative, or when a large amount of the second and third wall charges e2 and e3 exist while the amount of the first wall charge e1 is very slight, the polarity of the pulse voltage applied to the second electrode E2 may be changed, or the pulse voltage may be applied to the first or third electrode E1 or E3, not the second electrode E2.

Under the state in which the first through third wall charges e1 through e3 are distributed on the dielectric layer 200 as shown in FIG. 14, a predetermined voltage, e.g., a pulse voltage of −562.5 V, is applied to the second electrode E2 for several μs, taking account of the polarity of the second wall charge e2. Here, because a predetermined wall voltage has been induced between the first and second electrodes E1 and E2 by the first and second wall charges e1 and e2, the voltage applied to the second electrode E2 can be decreased by the predetermined wall voltage. If the pulse voltage is applied to the second electrode E2, the wall charge distribution on the dielectric layer 200 changes to a state shown in FIG. 15.

More specifically, when the negative voltage is applied to the second electrode E2, as described above, a discharge mainly occurs between the first and second electrodes E1 and E2. Here, positive charges move to the second electrode E2, and negative charges move to the first and third electrodes E1 and E3, so that the amounts of the first through third wall charges e1 through e3 on the dielectric layer 200 become the same. The first and third wall charges e1 and e3 are accumulations of the negative charges while the second wall charge e2 is an accumulation of the positive charges.

Subsequently, a predetermined pulse voltage, e.g., a pulse voltage of +562.5 V, is applied to the third electrode E3, and thus a discharge occurs throughout the space between a front panel and a rear panel. As described above, when a positive pulse voltage is applied to the third electrode E3, the wall charge distribution on the dielectric layer 200 changes to a state shown in FIG. 16.

More specifically, as shown in FIG. 6, a large amount of the second and third wall charges e2 and e3 exist on the predetermined regions of the dielectric layer 200, which correspond to the second and third electrodes E2 and E3, respectively, while only a slight amount of the first wall charge e1 exists on the predetermined region of the dielectric layer 200, which corresponds to the first electrode E1. Here, the second wall charge e2 is an accumulation of positive charges while the third wall charge e3 is an accumulations of negative charges.

After about 10 μs since the end of the application of the pulse voltage to the third electrode E3, a predetermined pulse voltage is applied to the second electrode E2. The predetermined pulse voltage has the same polarity as the second wall charge e2. For example, a pulse voltage of +562.5 V is applied to the second electrode E2. Then, negative charges move to the second electrode E2, and positive charges move to the first and third electrodes E1 and E3. As a result, the wall charge distribution on the dielectric layer 200 changes to a state shown in FIG. 17.

Figure 17:
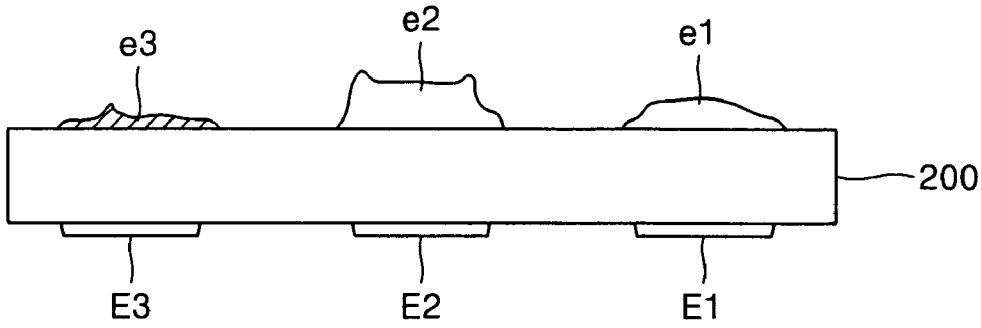

More specifically, referring to FIG. 17, a large amount of the first and second wall charges e1 and e2 exists on the predetermined regions of the dielectric layer 200, which correspond to the first and second electrodes E1 and E2, respectively, while only a slight amount of the third wall charge e3 exists on the predetermined region of the dielectric layer, which corresponds to the third electrode E3.

Thereafter, a predetermined pulse voltage having an opposite polarity to the first wall charge e1, e.g., a pulse voltage of −562.5 V, is applied to the first electrode E1 for several μs. Then, the wall charge distribution on the dielectric layer 200 changes to an initial state of the discharge sequence, i.e., a state shown in FIG. 14.

A method of sequentially applying predetermined pulse voltages to an electrode group composed of three electrodes, as described above, can be applied to a case where the electrode group is composed of four electrodes. Here, it is preferable to set a discharge sequence such that wall charges and space charges are optimally utilized.

Figure 18:
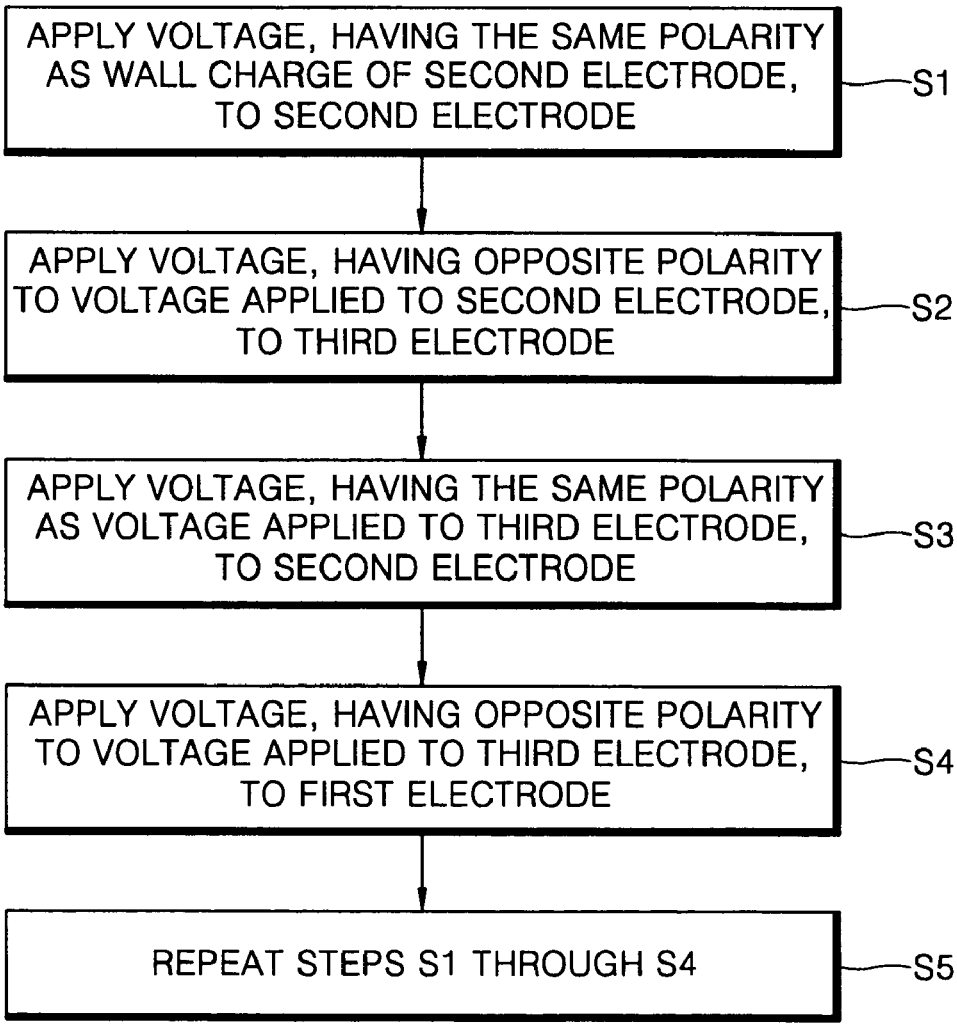
FIG. 18 is a flowchart of a method of driving the flat lamp according to the first embodiment of the present invention.
Figure 19:
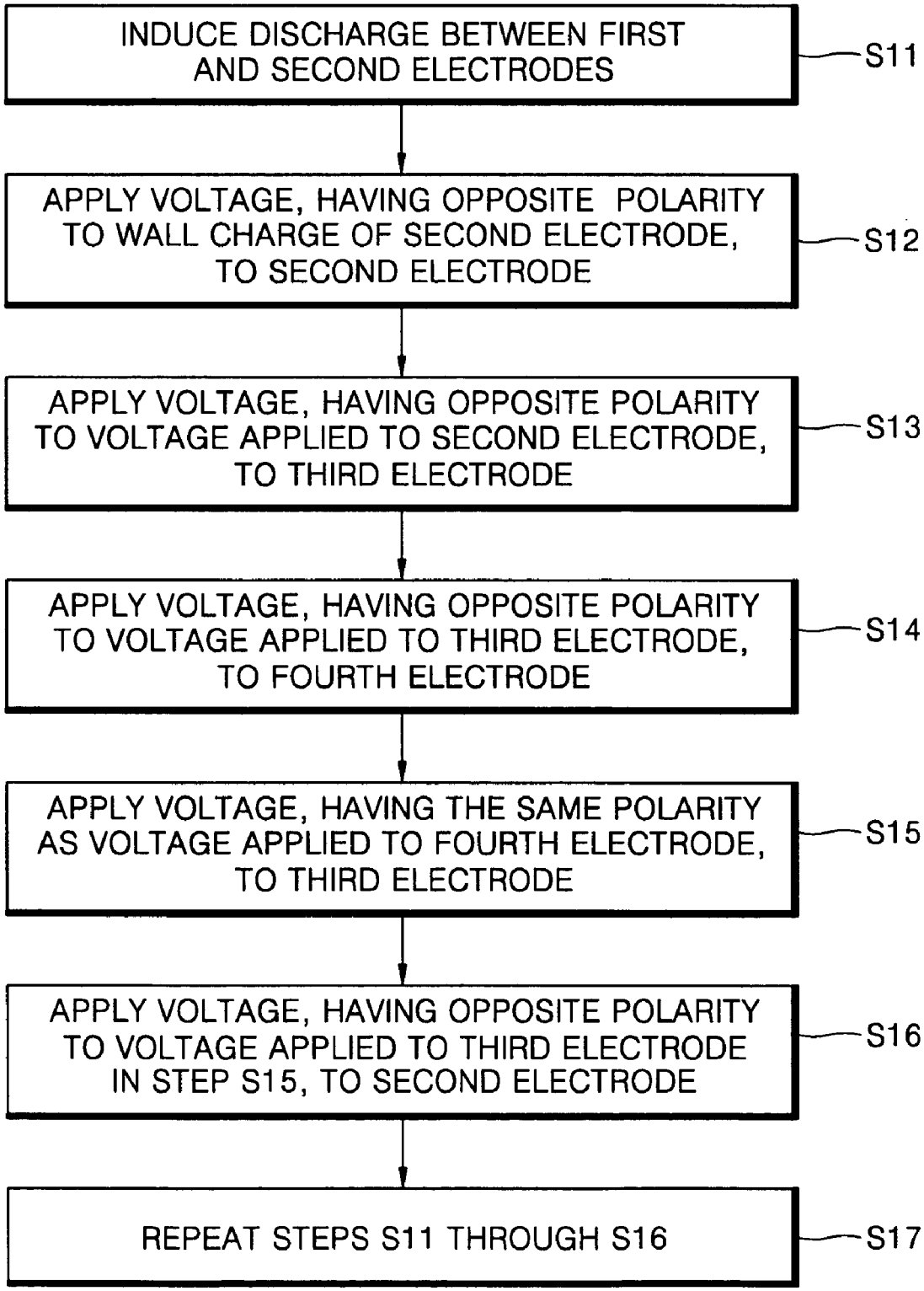
FIG. 19 is a flowchart of a method of driving the flat lamp according to the second embodiment of the present invention.

The above described methods of driving flat lamps can be summarized using the flowcharts of FIGS. 18 and 19, respectively. The flowchart of FIG. 18 summarizes a driving method (hereinafter, referred to as a first driving method) for a flat lamp including an electrode group composed of three electrodes in a rear panel, like the flat lamp including the first electrode group 66 shown in FIG. 3 according to the first embodiment of the present invention. The flowchart of FIG. 19 summarizes a driving method (hereinafter, referred to as a second driving method) for a flat lamp including an electrode group composed of four electrodes in a rear panel, like the flat lamp including the second electrode group 82 shown in FIG. 5 according to the second embodiment of the present invention.

Figure 4:
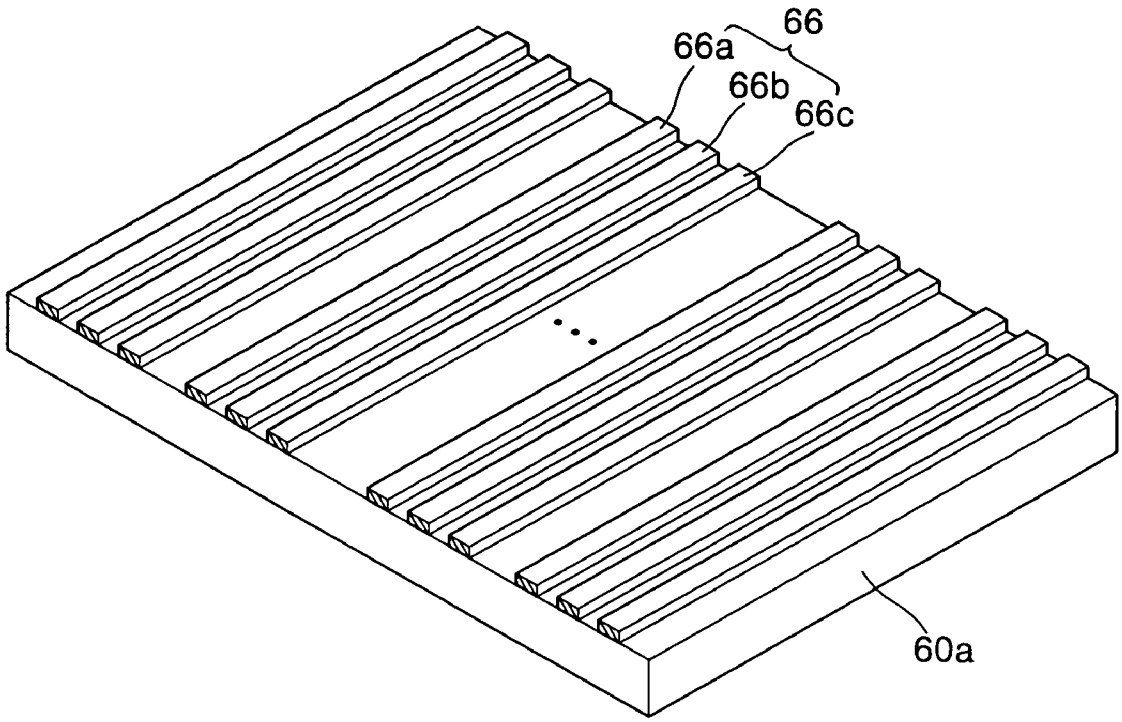
FIG. 4 is a perspective view of the flat lamp shown in FIG. 3, for showing the arrangement of electrodes.

The first driving method will be described with reference to FIG. 3 or 4 and FIG. 18. A voltage, for example, a square-pulse voltage or a sine-pulse voltage, having the same polarity as a wall charge, which has been induced on one electrode selected from the first through third electrodes 66*a*, 66*b*, and 66*c* constituting the first electrode group 66 by a previously applied voltage, is applied to the selected electrode (S1). Any one of the first through third electrodes 66*a*, 66*b*, and 66*c* can be selected, but for clarity of the description, it is assumed that the second electrode 66*b* is selected.

Taking account of wall charges newly distributed on the surface of the first rear dielectric layer 60*b* covering the first electrode group 66 and a distribution of space charges in the discharge space 64, which result from step S1, a voltage having an opposite polarity to the voltage applied to the second electrode 66*b* is applied to the third electrode 66*c* (S2). Then, the wall charge distribution on the surface of the first rear dielectric layer 60*b* and the space charge distribution in the discharge space 64 change.

Taking account of the wall charge distribution and the space charge distribution, which result from step S2, a predetermined voltage is applied to the second electrode 66*b* (S3). Preferably, the predetermined voltage has the same polarity as the voltage applied to the third electrode 66*c* in step S2. Then, the wall charge distribution on the surface of the first rear dielectric layer 60*b* and the space charge distribution in the discharge space 64 change to be different from those resulting from step S2.

Taking account of the wall charge distribution and the space charge distribution, which result from step S3, a predetermined voltage is applied to the first electrode 66*a* (S4). Preferably, the predetermined voltage has an opposite polarity to the voltage having been applied to the third electrode 66*c* in step S2.

With such operation, a single discharge sequence is completed, and the wall charge distribution and the space charge distribution recover to the states before step S1.

Steps S1 through S4 are repeated (S5).

The second driving method will be described with reference to FIGS. 5 and 19. Two adjacent electrodes are selected from the first through fourth electrodes 82*a*, 82*b*, 82*c*, and 82*d* constituting the second electrode group 82, and a voltage, e.g., a square-pulse voltage or a sine-pulse voltage, is applied to the two selected electrodes, thereby inducing a discharge between the two selected electrodes (S11). Then, wall charges are accumulated at regions on the second rear dielectric layer 80*b*, which correspond to the two selected electrodes, respectively. The two selected electrodes may be the first and second electrodes 82*a* and 82*b*, the second and third electrodes 82*b* and 82*c*, or the third and fourth electrodes 82*c* and 82*d*, but for clarity of the description, it is assumed that the two selected electrodes are the first and second electrodes 82*a* and 82*b*.

A predetermined voltage is applied to the second electrode 82*b* of the second electrode group 82 (S12). Here, the predetermined voltage has an opposite polarity to the wall charge induced in step S11 corresponding to the second electrode 82*b*. As a result, a wall charge distribution on the surface of the second rear dielectric layer 80*a* and a space charge distribution in the discharge space 64 change.

Taking account of the changed wall charge distribution and space charge distribution, a predetermined voltage is applied to the third electrode 82*c* (S13). Preferably, the predetermined voltage applied to the third electrode 82*c* has an opposite polarity to the voltage applied to the second electrode 82*b*. As a result, the wall charge distribution and the space charge distribution change again.

A predetermined voltage is applied to the fourth electrode 82*d* (S14). Preferably, the predetermined voltage applied to the fourth electrode 82*d* has an opposite polarity to the voltage having to the third electrode 82*c*, taking account of the wall charge distribution and the space charge distribution resulting from step S13.

A predetermined voltage is applied to the third electrode 82*c* (S15). Preferably, the predetermined voltage applied to the third electrode 82*c* has an opposite polarity to the voltage applied to the fourth electrode 82*d*, taking account of the wall charge distribution and the space charge distribution resulting from the previous step, i.e., step S14. As a result, the wall charge distribution and the space charge distribution change again.

A predetermined voltage is applied to the second electrode 82*b* (S16). Preferably, the predetermined voltage applied to the second electrode 82*b* has an opposite polarity to the voltage applied to the third electrode 82*c* in step S15, taking account of the wall charge distribution and the space charge distribution resulting from step S15.

With such operation, a single discharge sequence is completed, and the wall charge distribution and the space charge distribution recover to the states before step S11.

Steps S11 through S16 are repeated (S17).

As described above, in a flat lamp according to the present invention, each of a plurality of electrode groups included in a rear panel is composed of at least three electrodes. In a method of driving this flat lamp according to the present invention, a gas pressure and a gap between electrodes are maintained to be equal to those in the conventional technology, thereby preventing luminescence efficiency decreasing. In addition, since a voltage is sequentially applied to the electrodes taking account of a wall charge distribution and a space charge distribution, which were formed in a previous operation, and simultaneously, the polarity of the voltage is adjusted appropriately to the wall charge distribution and the space charge distribution, a discharge voltage is decreased.

Figure 20A:
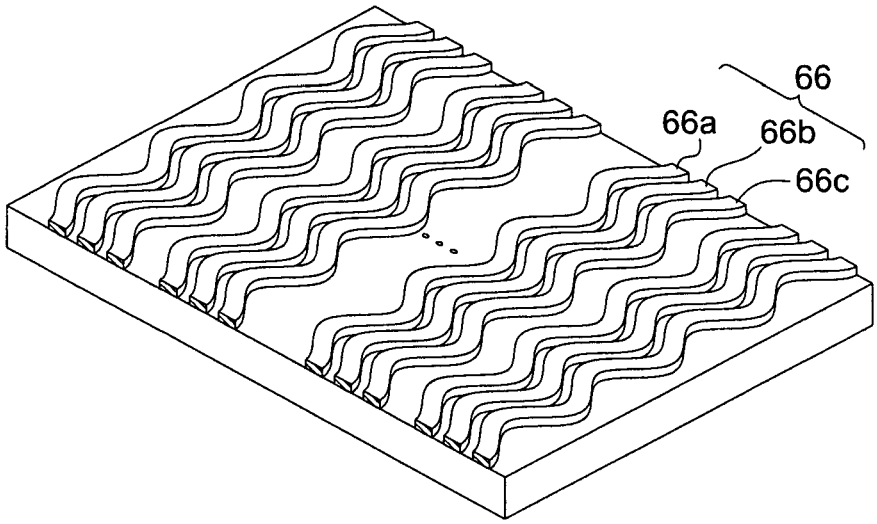
FIGS. 20A–C are perspective views of the inventive flat lamp showing the arrangement of electrodes in a sine-wave shape (FIG. 20A) a sawtooth shape (FIG. 20B), and a square-wave shape (FIG. 20C).
Figure 20B:
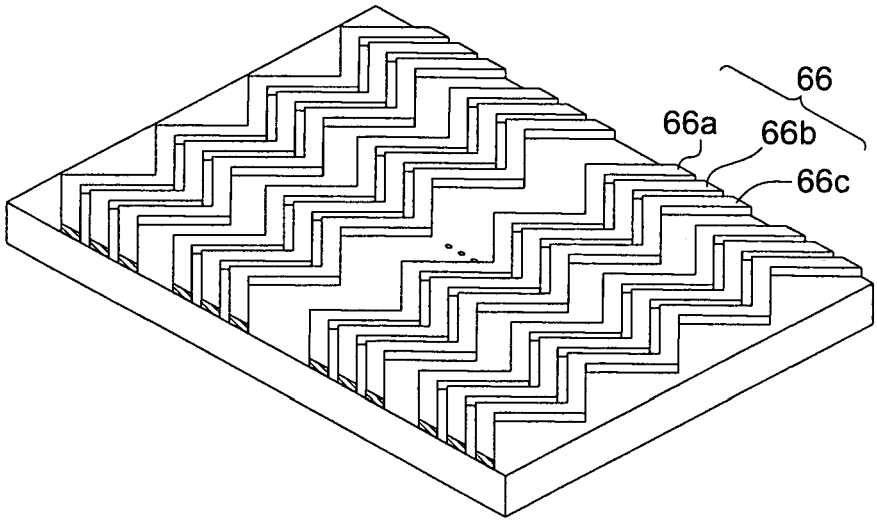
Figure 20C:
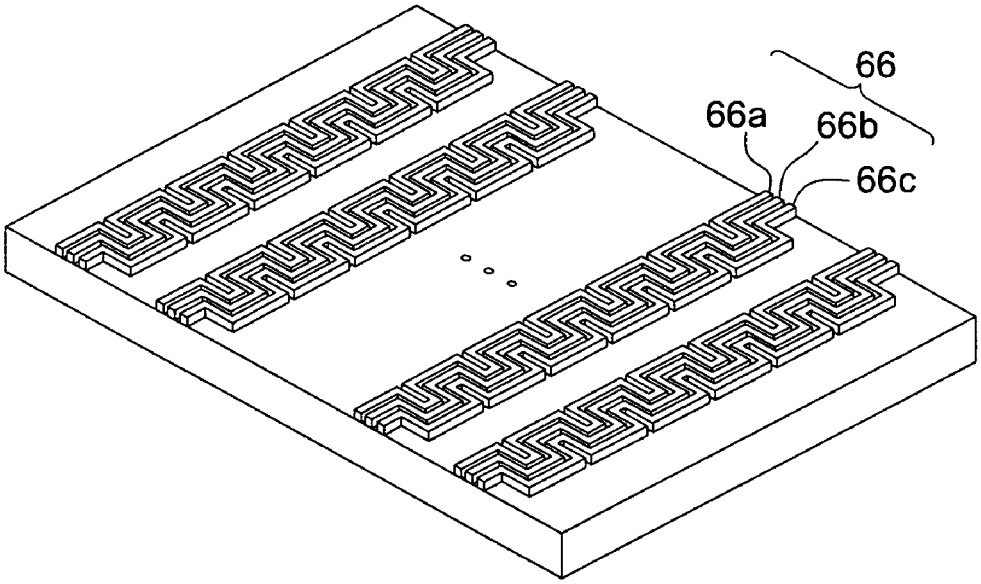

While this invention has been particularly shown and described with reference to preferred embodiments thereof, the preferred embodiments should be considered in descriptive senses only and not for purposes of limitation. For example, it will be understood by those skilled in the art that although electrodes constituting each of the first or second electrode groups or electrodes constituting each of the first or second electrode sets are fundamentally arranged in a striped pattern in the flat lamps according to the first through fourth embodiments of the present invention, the shape of the electrodes may be changed. For example, the electrodes may have a straight line shape (as shown in FIG. 4) or sine-wave shape (as shown in FIG. 20A) or sawtooth shape (as shown in FIG. 20B) or square-wave shape (as shown in FIG. 20C) or may be formed to have longitudinal tips. In addition, while a gap between the electrodes constituting the first or second electrode group is less than a gap between the first or second electrode groups, a gap between one electrode and an adjacent electrode may be different from a gap between the other electrodes including the adjacent electrode. In other words, although a gap between the electrodes constituting each of the electrode groups is constant in the first and second embodiment, the gap may vary. Therefore, the scope of the invention is defined by the appended claims, not by the detailed description of the invention.

What is claimed is:

1. A method of driving a flat lamp including a front panel and a rear panel, which are spaced a predetermined distance apart from each other and hermetically sealed, and a spacer, which is provided between the front panel and the rear panel to maintain the front and rear panels separated by the predetermined distance and secure a discharge space, wherein a predetermined discharge gas exists in the discharge space, a fluorescent layer is formed on an inner surface of at least one of the front and rear panels, and a plurality of electrode groups each comprising first, second, and third electrodes are provided in the rear panel, the method comprising:

(a) applying a first voltage to a first selected electrode among the first through third electrodes, taking account of a wall charge distribution and a space charge distribution, which were formed previously;

(b) applying a second voltage to a second selected electrode adjacent to the first selected electrode among the first through third electrodes, taking account of a wall charge distribution and a space charge distribution, which result from the application of the first voltage;

(c) applying a third voltage to the first selected electrode, taking account of a wall charge distribution and a space charge distribution, which result from the application of the second voltage; and (d) applying a fourth voltage to an unselected electrode among the first through third electrodes.

2. The method of claim 1, wherein the first voltage has the same polarity as a wall charge previously induced in the first selected electrode.

3. The method of claim 2, wherein the second voltage has an opposite polarity to the first voltage.

4. The method of claim 3, wherein the third voltage has the same polarity as the second voltage.

5. The method of claim 4, wherein the fourth voltage has an opposite polarity to the third voltage.

6. The method of claim 2, wherein the first and second selected electrodes are the second and third electrodes, respectively.

7. The method of claim 2, further comprising repeating steps (a) through (d) after step (d).

8. A method of driving a flat lamp including a front panel and a rear panel, which are spaced a predetermined distance apart from each other and hermetically sealed, and a spacer, which is provided between the front panel and the rear panel to maintain the front and rear panels separated by the predetermined distance and secure a discharge space, wherein a predetermined discharge gas exists in the discharge space, a fluorescent layer is formed on an inner surface of at least one of the front and rear panels, and a plurality of electrode groups each comprising first, second, third, and fourth electrodes are provided in the rear panel, the method comprising:

(a) inducing a discharge between a first selected electrode and an adjacent second selected electrode among the first through fourth electrodes;

(b) applying a first voltage to the second selected electrode, taking account of a wall charge distribution and a space charge distribution, which result from the discharge;

(c) applying a second voltage to a third selected electrode adjacent to the second selected electrode, taking account of a wall charge distribution and a space charge distribution, which result from the application of the first voltage;

(d) applying a third voltage to an unselected electrode among the first through fourth electrodes, taking account of a wall charge distribution and a space charge distribution, which result from the application of the second voltage;

(e) applying a fourth voltage to the third selected electrode, taking account of a wall charge distribution and a space charge distribution, which result from the application of the third voltage; and (f) applying a fifth voltage to the second selected electrode, taking account of a wall charge distribution and a space charge distribution, which result from the application of the fourth voltage.

9. The method of claim 8, further comprising repeating steps (a) through (f) after step (f).

10. The method of claim 8, wherein the first through fifth voltages have the same magnitude.

11. The method of claim 8, wherein the first voltage has the same polarity as a wall charge induced by the discharge.

12. The method of claim 11, wherein the second voltage has an opposite polarity to the first voltage.

13. The method of claim 12, wherein the third voltage has an opposite polarity to the second voltage.

14. The method of claim 13, wherein the fourth voltage has the same polarity as the third voltage.

15. The method of claim 14, wherein the fifth voltage has an opposite polarity to the fourth voltage.

16. A flat lamp comprising:

a front panel, wherein radiated visual light is transmitted outside the flat lamp through the front panel;

a rear panel, which is separated from the front panel by a predetermined distance and hermetically sealed to the front panel;

a spacer, which maintains the front and rear panels separated by the predetermined distance and secures a discharge space between the front and rear panels;

a discharge gas, which exists in the discharge space;

a fluorescent layer formed on an inner surface of at least one of the front and rear panels; and a plurality of electrode groups formed in the rear panel, each electrode group comprising at least three electrodes, wherein two of said at least three electrodes are adapted to sustain a discharge voltage, and a third is adapted to function as an igniter for decreasing a discharge voltage.

17. The flat lamp of claim 16, wherein the rear panel comprises:

a rear glass substrate, which is provided with the electrode groups;

a dielectric layer, which is formed on the rear glass substrate to cover the electrode groups; and a fluorescent layer formed on the dielectric layer.

18. The flat lamp of claim 16, wherein the front panel comprises:

a front glass substrate;

a dielectric layer, which is formed on a back surface of the front glass substrate; and a fluorescent layer formed on a back surface of the dielectric layer.

* * * * *